United States Patent [19]

Guérette

[11] 4,044,857

[45] Aug. 30, 1977

[54] MOBILE LADDER

[75] Inventor: Marcel Guérette, Lachenaie, Canada

[73] Assignee: Moody Si Ltd., Terrebonne, Canada

[21] Appl. No.: 686,736

[22] Filed: May 17, 1976

[51] Int. Cl.[2] ..... E06C 5/04

[52] U.S. Cl. ..... 182/17; 182/106; 182/127; 182/152

[58] Field of Search ..... 182/127, 15, 17, 106, 182/20, 165, 173, 68, 152, 156

[56] References Cited

U.S. PATENT DOCUMENTS

| | | | |
|---|---|---|---|
| 92,527 | 7/1869 | Hartman | 182/68 |
| 3,139,155 | 6/1964 | Skeels | 182/106 |

*Primary Examiner*—Reinaldo P. Machado
*Attorney, Agent, or Firm*—Alan Swabey & Co.

[57] ABSTRACT

A mobile ladder has a base, castors mounted to the base, a ladder connected to the base, a support member connected at one end to the base and at the other end to the ladder forming a structural triangle between the members, the ladder including a floor engaging member affixed thereto. The connection of the ladder to the base includes a link member which also forms a step of the ladder, pivotally mounted to the base about a first axis, and the link is also connected to the ladder about a pivot having an axis parallel to the first axis. The link is adapted to pivot about the first axis such that the ladder, if it follows an arc between the first position where the ladder is engaging the floor in frictional contact therewith and a second position whereby the ladder pivot with the link is passed over the gravitational dead center above the first axis and the ladder is cleared of the floor.

7 Claims, 5 Drawing Figures

MOBILE LADDER

BACKGROUND OF THE INVENTION

1. Field of the Invention

The present invention relates to mobile ladders, and more particularly, to a mobile ladder having a floor lock.

2. Description of the Prior Art

Mobile ladders having floor locks used in warehouses or for maintenance use are well known. Examples of such mobile ladders are described in U.S. Pat. Nos. 1,439,388, Willett, 1922; 2,798,652, Easton, 1957; 2,923,373, Ledgerwood, 1960; 3,155,190, Borgman, 1964; 3,175,641, Mihalik, 1965; and 3,291,254, Mihalik, 1966.

The purpose for which such mobile ladders are used and the reason for a wheel or floor lock is well documented in these patents. In summary, the mobile ladder includes a frame on which a step ladder is provided at a permanently useful angle, and castor wheels on the frame for the purpose of moving the frame and ladder to any location on a given floor in a building. When it is required to mount the ladder, the floor lock is engaged so as to prevent the ladder from moving while a person is on the ladder and thereby possibly causing accidents.

The floor locks of present day mobile ladders appear to be of two types. In the Borgman, Ledgerwood, Easton, and both Mihalik patents, there is described a floor lock in which at least a wheel is movable in a vertical plane between a floor engaging position and a floor disengaging position where accompanying support members or stops would be engaging the floor preventing the mobile ladder from moving. In the other type of floor lock, reference can be made to the Willett patent as well as U.S. Pat. No. 2,897,910, Steely et al, 1959, referring to a service cart having a floor lock. In these patents, the castor wheels are fixed to the frame while a separate movable support member can be actuated to lift the frame off the floor, thereby lifting certain wheels which are fixed to the frame. All of the floor locks referred to in the above patents include floor lock linkage systems which are relatively complicated and which require a number of parts which, of course, must be maintained. Many of the patents use spring-loaded mechanisms which add to the complexity of the construction and can lead to unreliability of the devices.

SUMMARY OF THE INVENTION

It is an aim of the present invention to provide a floor lock for a mobile ladder which is simple in construction, relatively inexpensive to manufacture, and is mechanically more reliable.

It is a further aim of the present invention to provide a mobile ladder which can be collapsed for easy transportation.

A construction in accordance with the present invention includes a base, a ladder connected to the base, a support member connected at one end to the base spaced from the ladder connection with the base, and at its other end the support member is hingedly connected to the ladder at a point spaced from the ladder and base connection, thereby forming a structural triangle therewith, castors mounted to the base adapted to provide mobility to the base, the ladder including at least a floor engaging member fixed thereto, the connection of said ladder to said base including a link member pivotally mounted to the base about a first axis normal to a plane through the structural triangle, said link being pivotally connected to the ladder about a pivot having an axis parallel to the first axis and spaced therefrom, the link being adapted to pivot about the first axis such that said ladder pivot follows an arc between a first position whereby the floor engagement member of the ladder is in frictional contact with a floor surface, and a second position whereby the ladder pivot with the link is passed over a gravitational dead center position above the first axis, whereby said floor engaging member of said ladder is spaced from the floor surface.

In a further embodiment of the present invention, there is provided guide rails mounted to side members forming the ladder and adapted to be folded thereon, and the connection of said support to said base being detachable so as to fold the support member about the hinge connection with the ladder, to the ladder and to fold the ladder and the support member about the connection of the ladder with the base to the base.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
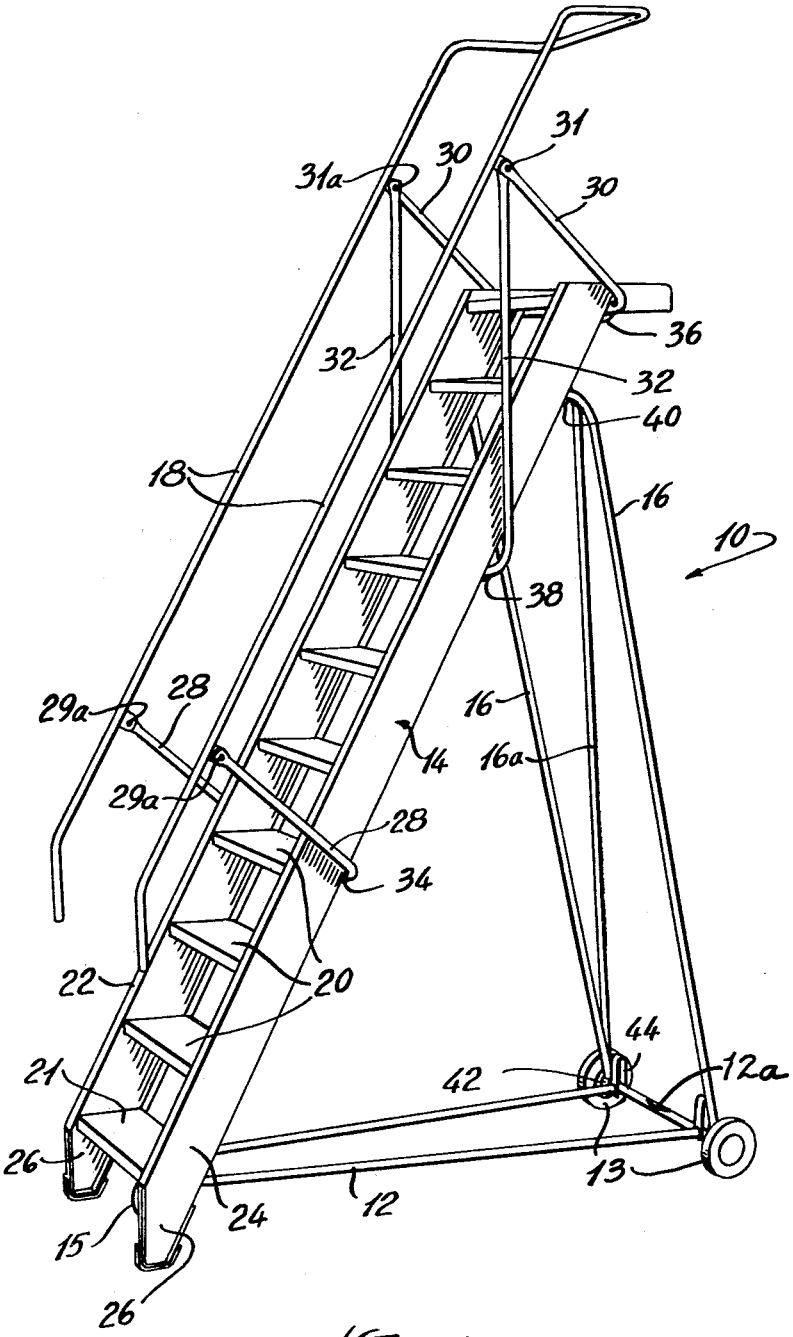
FIG. 1 is a perspective view of a mobile ladder.
Figure 2:
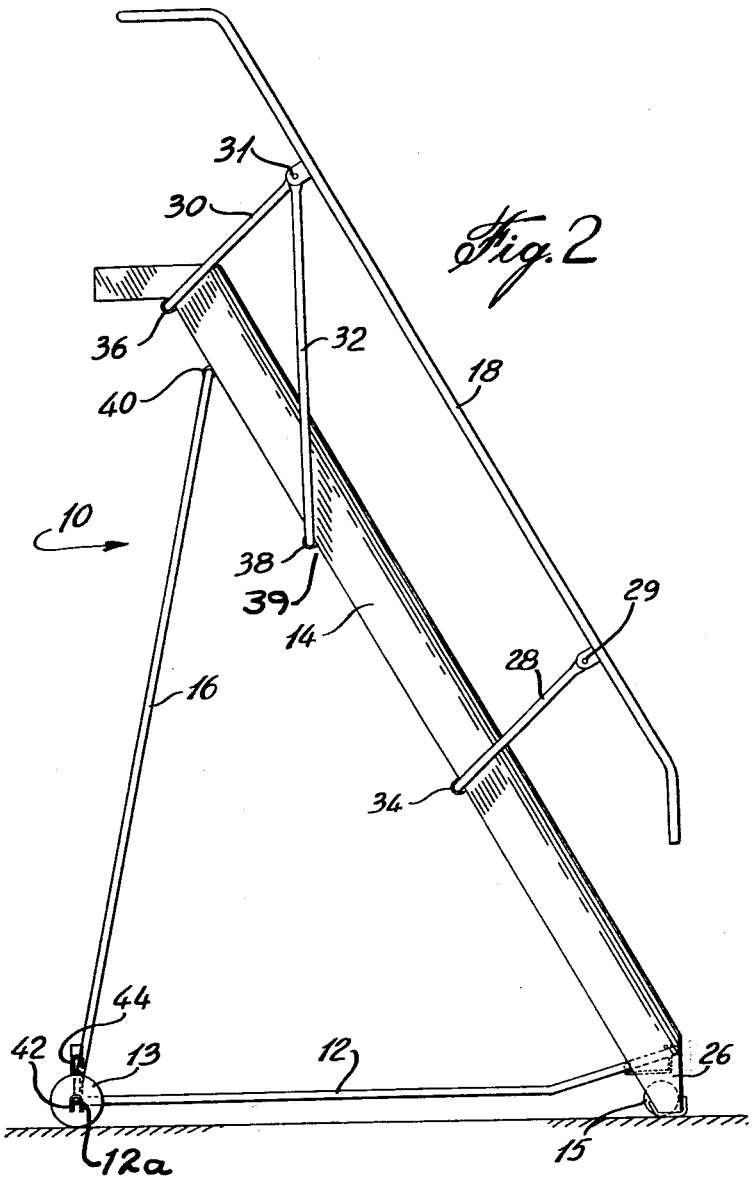
FIG. 2 is a side elevation thereof.
Figure 5:
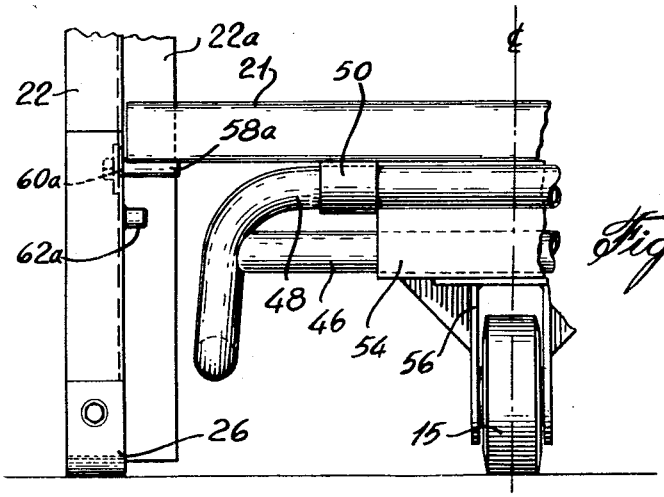
FIG. 5 is a fragmentary elevational enlarged view of the details shown in FIG. 4

Referring now to the drawings and particularly to FIGS. 1 and 2, there is shown a mobile ladder 10 made up of a base 12, a ladder 14 and a support member 16 forming a structural triangle between the ladder 14, the support 16, and the base 12. The base 12 is somewhat trapezoidal in plan view with a member **12*a* to which castor wheels 13 are mounted, and at the other end the member 48 (as shown in FIGS. 2 and 5) mounts a castor wheel 15** as will be described further.

The support member 16 is also made of tubular steel members bent as shown and forms a somewhat U-shaped rectangular outline having U-shaped brackets 42 at each end of the so-formed legs thereof which engages the base member **12*a* adjacent wheels 13. Suitable locking nuts can also be provided to lock the U-shaped brackets to the base frame member 12*a*. The connection is a pivoting connection so that the support member 16 can pivot about the axis of the member 12*a***.

The ladder 14 comprises a pair of flanged side members 22 and 24 subtending a plurality of steps 20, including the lower step 21 which will be described further.

A guard rail 18 is also provided and is supported to the ladder 14 by means of tubular braces 28, 30 and 32. Each of these braces is of continuous U-shaped bent tubular construction, and each is pivotally mounted to the ladder by means of pivot brackets 34, 36 and 38 respectively. The guard rail 18 per se is also of elongated tubular steel construction and is bent as shown. The braces 28, 30 and 32 are connected to the guard rail 18 by means of pivot pins **29*a*, 29*a* and 31*a*, 31*b* respectively. The braces 28, 30 and 32 are, of course, pivotally mounted, as described above, to the ladder and the guard rail, and brace 32 provides a stabilizer for the otherwise folding parallelogram, by providing a structural triangle between points 36, 38 and 31.**

Figure 3:
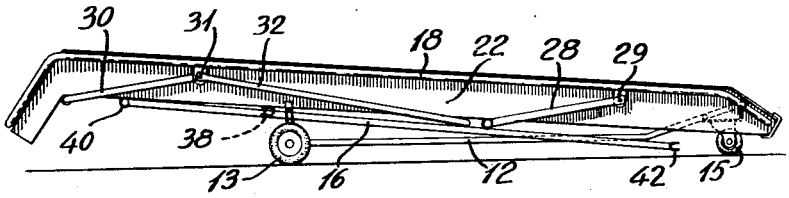
FIG. 3 is a view of the mobile ladder in a collapsed condition.

When it is necessary to collapse the mobile ladder 10, the bolt and nut arrangement 39 is detached allowing the brace 32 to be removed from the bracket 38 and thereby allowing the parallelogram, including the guard rail 18, to collapse on the ladder 14, as shown in FIG. 3. The support member 16 is detached from the base member 12*a* by means of removing the nut and bolt locking arrangement, holding the U-shaped brackers 42 to the member 12*a.* The support member 16 is then folded inwardly against the ladder 14, and the ladder 14 with the support member is pivoted downwardly onto the base 12. Pillow blocks 44 are provided on the base member 12*a* to support the ladder 14, as shown in FIG. 3, when the whole is collapsed. It is noted from FIG. 3 that the collapsed mobile ladder can still be moved since the collapsed structure is completely supported on the base 12 and, therefore, on the castor wheels 13 and 15.

Figure 4:
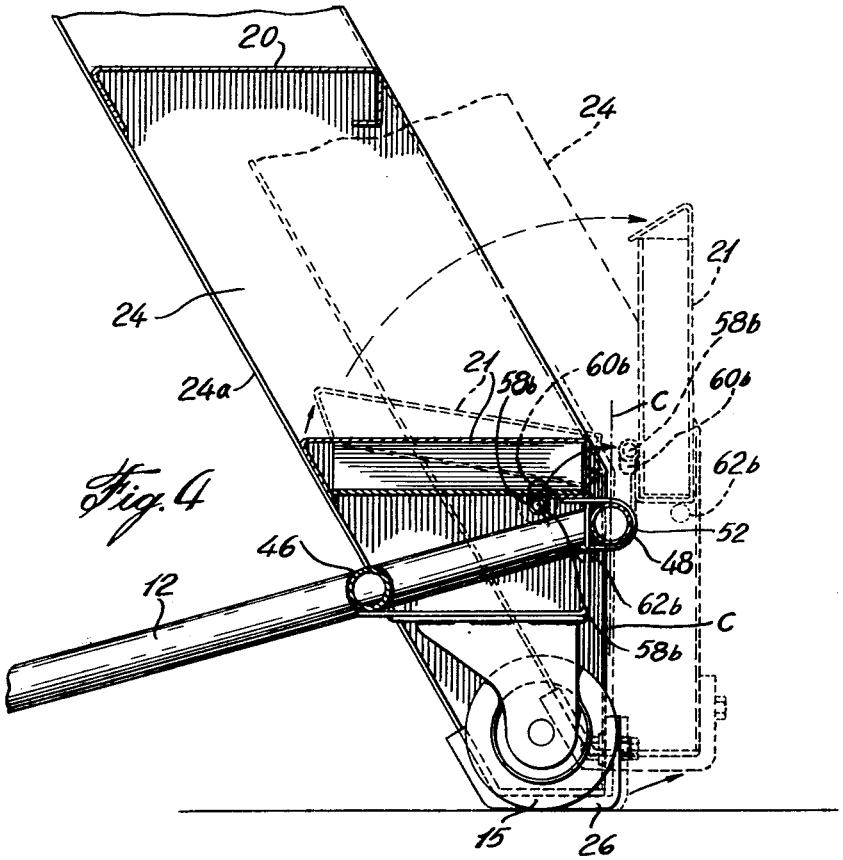
FIG. 4 is an enlarged vertical cross-section of a detail of the mobile ladder.

Reference will now be made to FIGS. 4 and 5 which illustrate the floor locking mechanism.

Both side members 22 and 24 include extensions referred to as floor engagement members 26. A high friction pad such as rubber can be provided under the members 26. The frame 12, as shown in FIGS. 4 and 5, includes a cross member 46 parallel to the end member 48 of the trapezoidal shaped base 12. To the cross member 46 and the member 48 is welded a support bracket 54 on which there is a castor bracket 56 mounting a single castor wheel 15.

The step member 21 is hinged to the member 48 of the base 12 by means of journal sleeves 50 and 52. The step member 21 is also pivotally connected to the ladder 14 by means of stub shafts 58*a* and 58*b* sliding in lost motion slots 60*a* and 60*b* in side members 22 and 24 respectively. The axis of the stub shafts 58*a* and 58*b* is parallel to but spaced from the axis of the end member 48 about which the step member 21 is adapted to pivot.

The step member 21, when it is in an operative position as shown in full lines in FIGS. 4 and 5, abuts against a flange 22*a* and 24*a* of the side members 22 and 24 to allow a stable step for use when the ladder is being mounted.

When it is not required to use the ladder, that is, to climb the ladder, but it is required to move the ladder, the step ladder 21 may be manually pivoted clockwise as shown in FIG. 4, to a position illustrated in dotted lines in a vertical plane. In moving from a horizontal plane to the vertical plane, the stub shafts 58*a* and 58*b* travel the distance of the lost motion slots and then through an arc illustrated by the arrow in FIG. 4. Along the arc the stub shafts have a vertical component as shown, lifting the side members 22 and 24 and thus the floor engaging members 26 an equivalent vertical distance off the floor whereby only the castor wheel 15 is engaging the floor. The weight of the ladder 14 is distributed on the structural triangle so formed. In view of the hinge at 40, there is a horizontal force component outwardly at the bottom of the ladder 14 and support 16. Thus, the force required to pivot the step member 21 clockwise is reduced by the existing force component.

An abutment 62*a* and 62*b* is provided on the respective side members 22 and 24 which limit the clockwise pivoting movement of the steps 21.

It is also noted that in the vertical position shown in dotted lines in FIG. 4, the stub shaft 58*b* is past the gravitational dead center over the axis of the member 48 about which the step 21 pivots. Accordingly, in this position, the ladder 14 will be locked in a vertically spaced position from the ground, and in view of the fact that the axis of the stub shafts 58*a* and 58*b* are past the dead center position C—C, they will not be urged back down until manual force is provided on the lever-step 21 in a counterclockwise movement, thereby pivoting the step back past the dead center C—C to its initial horizontal position whereby the floor engagement members 26 of the ladder 14 will engage the floor preventing mobility of the mobile ladder.

I claim:

1. A mobile ladder comprising a base, castors mounted to the base adapted to provide mobility thereto, a ladder connected to the base, a support member connected at one end to the base at a point spaced from the ladder connection with the base, and the other end of the support member being hingedly connected to the ladder at a point spaced from the ladder and base connection, forming a structural triangle therewith; the ladder including a floor engaging member fixed thereto and adapted to engage the floor, the connection of said ladder to said base including a link member pivotally mounted to the base about a first axis normal to the plane through the structural triangle, said link being pivotally connected to the ladder about a pivot having an axis parrallel to the first axis and spaced therefrom, the link being adapted to pivot about the first axis such that said ladder pivot follows an arc between a first position whereby the floor engagement member of the ladder is in frictional contact with the floor surface and a second position whereby the ladder pivot with the link is passed over the gravitational dead center position above the first axis, and whereby said floor engaging member of said ladder is spaced from the floor surface.

2. A mobile ladder as defined in claim 1, where at least a guard rail member is provided on said ladder and at least two spaced-apart brace members are pivotally connected to the guard rail and to the ladder forming a quadrilateral therewith, the quadrilateral structure with the guard rail being foldable on the ladder and releasable means for retaining said guard rail in an erected position.

3. A mobile ladder as defined in claim 1, wherein the support member is detachable connected to the base such that the support member can be pivotally folded onto said ladder, said ladder and said support member can be collapsed onto said base, and said collapsed mobile ladder retains its mobility.

4. A mobile ladder as defined in claim 1, wherein the base includes a frame of trapezoidal outline with a shaft member at the base of the trapezoid to which castor wheels are mounted at each end thereof and at the other end of the frame an elongated member is provided to which the link member is pivotally mounted about the first axis.

5. A mobile ladder as defined in claim 1, wherein the ladder includes a pair of parallel flanged side members subtending step members therebetween and said link includes a platform also functional as a step member between the side members and the link member being journaled to a member of the frame forming the base.

6. A mobile ladder as defined in claim 5, wherein the base includes a trapezoidal shaped from with a shaft member forming the base of the frame and mounting opposed castor wheels and a single castor wheel mounted at the other end of the trapezoidal frame and the frame including a further cross member parallel to the end member of the frame, a supporting bracket to which the castor wheel is mounted, the link member, which is in the shape of a platform forming a step for the ladder, being pivotally mounted to the end member of the frame forming the base, said side members of the ladder mounting downward extensions forming the ground engaging members, the link member including stub shafts extending through lost motion slots in each of the side members, and an abutment member extending from at least one of the side members adapted such that when the link member is in a vertical position past the dead center, the link abuts against the abutment member on the side member.

7. A mobile ladder as defined in claim 2, wherein the means for maintaining the quadrilateral guard rail assembly in an erected position includes a brace detachably connected to the ladder and to one of the pivot points of one of the braces to the guard rail forming a structural triangle therewith.

* * * * *